US005375432A

United States Patent [19]

Cur

[11] Patent Number: 5,375,432

[45] Date of Patent: Dec. 27, 1994

[54] ICEMAKER IN REFRIGERATOR COMPARTMENT OF REFRIGERATOR FREEZER

[75] Inventor: Nihat O. Cur, St. Joseph, Mich.

[73] Assignee: Whirlpool Corporation, Benton Harbor, Mich.

[21] Appl. No.: 176,027

[22] Filed: Dec. 30, 1993

[51] Int. Cl.[5] ..... F25C 5/02

[52] U.S. Cl. ..... 62/320; 62/351; 62/344; 62/442

[58] Field of Search ..... 62/66, 71, 344, 340, 62/442, 351, 342, 320, 440

[56] References Cited

U.S. PATENT DOCUMENTS

| | | | |
|---|---|---|---|
| 2,493,488 | 1/1950 | Jordan et al. | 62/442 |
| 2,709,343 | 5/1955 | Muffly | 62/442 |
| 2,765,633 | 10/1956 | Muffly | 62/442 |
| 3,918,267 | 11/1975 | Canter | 62/320 |
| 4,942,979 | 7/1990 | Linstromberg et al. | 62/340 |

*Primary Examiner*—John M. Sollecito
*Attorney, Agent, or Firm*—Stephen D. Krefman; Thomas J. Roth; Robert O. Rice

[57] ABSTRACT

A refrigeration appliance is provided which has a freezer compartment, a fresh food compartment and a refrigeration system for cooling the two compartments. Two evaporators operating at different temperatures, or a single evaporator operating at sequentially different temperatures is used in the refrigeration system to provide the cooling of the two compartments. An ice making device is provided in the fresh food compartment, thermally associated with the evaporator used to cool the fresh food compartment operating at a warmer temperature, such that ice is formed and stored in the fresh food compartment. Dispensing means extending through the door of the fresh food compartment are provided to allow for dispensing of ice through the fresh food compartment door.

17 Claims, 1 Drawing Sheet

ICEMAKER IN REFRIGERATOR COMPARTMENT OF REFRIGERATOR FREEZER

BACKGROUND OF THE INVENTION

The present invention relates to a refrigeration appliance and more particularly to a domestic refrigerator having an automatic icemaker as well as both a fresh food compartment and a freezer compartment.

Refrigeration appliances for domestic use typically have a freezer compartment and a fresh food compartment. The freezer compartment is maintained at a temperature below 0° C. while the fresh food compartment is maintained below room temperature but above 0° C. In some refrigeration appliances it is known to provide automatic ice making equipment in which water supplied On a continuous basis to the refrigeration appliance is periodically dispensed into the ice making equipment to form ice cubes.

Typically these refrigeration appliances have a single evaporator and the icemaker is placed in the freezer compartment. The capacity of such icemakers are generally limited to around five pounds of ice per day since they rely on natural convection during the off cycle of the freezer and forced convection during the on cycle of the freezer to freeze the water to make ice. Since the icemaker relies on freezer air which is cooled by an evaporator, typically operated around −15° F. (−26° C.), it substantially increases the energy consumption of the unit.

This type and location of the icemaker, being in a freezer compartment, does not lend itself to an outside ice and water dispenser well for top mount or bottom mount freezer compartments. Thus, such an arrangement is generally provided only in side-by-side refrigerators. Also, since the water freezing in the icemaker is stationary, air trapped in the water and the impurities in the water result in producing ice cubes that are usually cloudy.

It would be advantageous if there were provided an ice making system which could have a greater capacity of ice making using lower energy consumption, which could make clear ice cubes and which could be provided in top mount or bottom mount combination refrigerator-freezer appliances.

SUMMARY OF THE INVENTION

The present invention provides an ice making system in a refrigeration appliance wherein the fresh food compartment and the freezer compartment are sequentially, but not simultaneously Cooled by the evaporator. In some instances, two separate evaporators may be used and which would be operated sequentially. These types of refrigeration devices are disclosed in co-pending U.S. application Ser. No. 07/961,306, filed Oct. 15, 1992.

The ice making system utilizes the evaporator as it is being utilized to cool the fresh food compartment. Typically this evaporator is operated at a temperature to 15° to 20° F. (−10° to −6° C.) which is substantially warmer than the evaporator temperature for Cooling the freezer compartment. The ice making system is thus positioned in the fresh food compartment rather than the freezer compartment.

By utilizing the warmer evaporator which operates at a higher evaporating temperature, the compressor cooling capacity is roughly doubled, providing ample cooling capacity to make substantial quantities of ice. Applicant has utilized such a system to, produce a pound of ice within ten to twelve minutes while cooling the refrigeration compartment. This permits the amount of ice stored in the storage bin to be much smaller since the system can provide ice cubes much more quickly. The ice cubes are dispensed to a collection bin which is insulated to prevent excessive melting.

In a preferred arrangement the icemaker includes a flat surface in thermal communication with the evaporator tubing used to cool the refrigeration compartment. A water dispenser is provided to dispense water onto the flat surface in a continuous manner (circulating water flow using a small water pump) where the ice will form. The ice slab may be removed from the ice making surface, such as by slightly heating the surface, and moved onto a heated wire grid to form ice cubes. Other configurations for the ice forming device could be provided as well, such as by forming individual cubes attached to each other with a thin layer of ice such that when the ice is harvested, the bridges would break and individual ice cubes would result.

Since the ice cubes are contained in an insulated section in the fresh food compartment, very little melting occurs. However, any melting of the ice is not lost energy since it removes heat from the fresh food compartment to keep that compartment cold longer.

By placing the ice making system in the fresh food compartment, access to the storage bin can be provided directly through the refrigeration compartment door, without requiring opening of the door. This permits usage of such an ice making system not only in side-by-side refrigeration devices but in top mount or bottom mount combination appliances as well.

Further, by utilizing an evaporator which is maintained slightly below freezing, but not excessively below freezing, the energy usage to make the same amount of ice will be considerably less than the ice made by conventional icemakers which are cooled in the freezer compartment with a colder evaporator. Since the preferred arrangement allows continuous water flow over the freezing surface, the resulting ice cubes would be clear as they are in commercial icemakers. The invention can also be used by leaving the water stationary against the below freezing surface as in a conventional domestic icemaker. In this case all the benefits of the invention would still be realized except the resulting ice cubes would be cloudy.

DETAILED DESCRIPTION OF THE PREFERRED EMBODIMENTS

Figure 1:
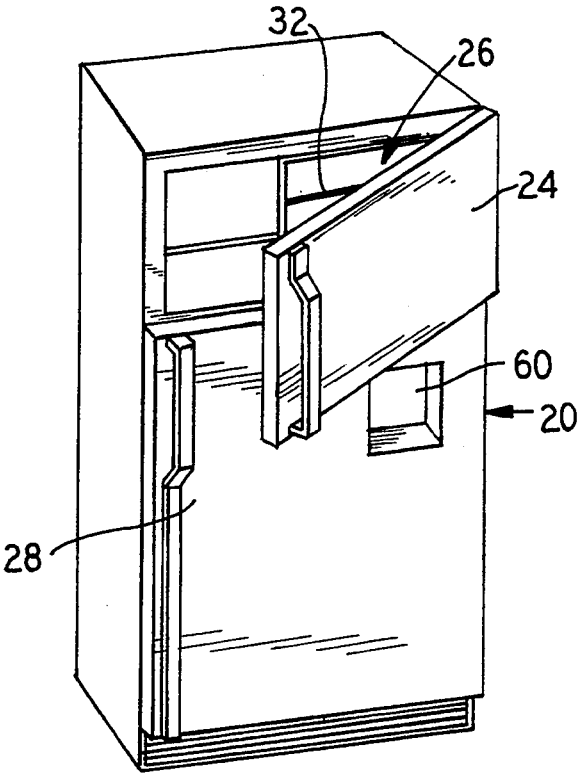
FIG. 1 is a perspective view of a refrigeration device embodying the principles of the present invention.
Figure 2:
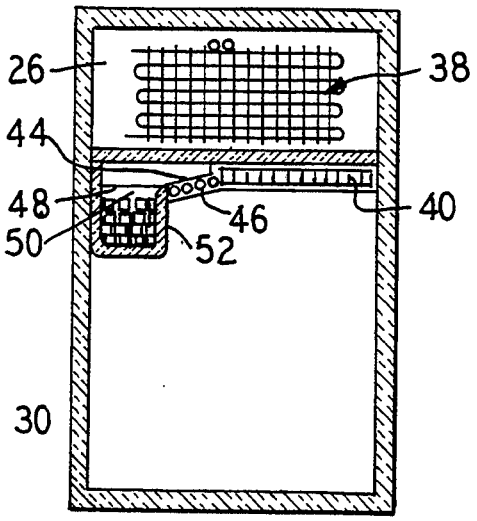
FIG. 2 is a section view of the refrigeration device of FIG. 1 illustrating the arrangement of an ice making system in accordance with the present invention.

In FIGS. 1 and 2 there is shown generally a refrigeration appliance at 20 which comprises an exterior cabinet 22 having a first openable door 24 to expose a first interior compartment 26 and a second openable door 28 to expose a second interior compartment 30. Within each of the compartments 26, 30 there may be one or more shelves 32 for receiving food articles. Generally one of the compartments 26, 30 will be maintained at a temperature sufficiently below 0° C. to assure that all of the articles contained within that compartment will be maintained in a frozen state. The other compartment generally is maintained somewhat above 0° C. to maintain the items placed therein in a chilled, but not frozen condition.

In order to maintain the compartments at the desired temperature levels, a refrigeration device, as is disclosed in pending U.S. Ser. No. 07/930,968, filed Aug. 14, 1992 (incorporated herein by reference), is provided which includes an evaporator 38 for the first compartment 26 and a second evaporator 40 for the second compartment 30. Appropriate air moving devices (not shown) are provided for circulating air within each of the compartments passed its respective evaporator to maintain a fairly consistent temperature throughout each compartment.

Alternatively, a single evaporator can be utilized to cool both compartments with appropriate movable baffles arranged to direct the air flow over the evaporator between the two compartments as disclosed in U.S. Ser. No. 07/930,104, filed Aug. 14, 1992, incorporated herein by reference.

Figure 3:
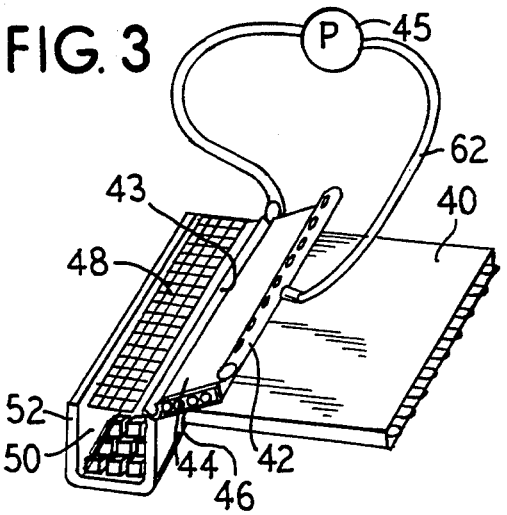
FIG. 3 is an enlarged view of an embodiment of the ice making system of FIG. 2.

In the arrangement illustrated in FIGS. 1 and 2, the compartment 26 is referred to as a freezer compartment and is maintained below 0° C. while the compartment 30 is referred to as a fresh food compartment and is maintained at a temperature above 0° C. As shown in greater detail in FIG. 3, a dispenser 42 is provided for dispensing water across an entire width of a flat surface 44 which is positioned closely adjacent to the evaporator 40. Preferably the dispenser 42 provides a continuous flow of water onto the surface 44 and any excess, unfrozen water is collected by a trough 43 and is recirculated by a small water pump 45. The surface 44, is in direct contact with some of the evaporator tubing, and thus is thermally influenced by the evaporator and, during operation of the evaporator, is caused to have its temperature lowered below freezing. Thus, when the water from the dispenser 42 is dispensed onto the surface 44, the water freezes.

Figure 3A:
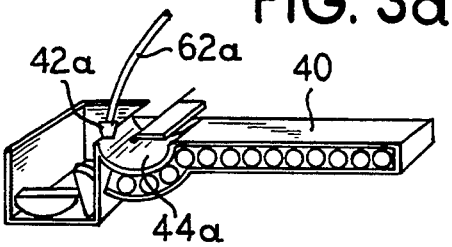
FIG. 3*a* is an enlarged view of an alternative embodiment of the ice making system of FIG. 2.

As shown in greater detail in FIG. 3*a*, a dispenser 42*a* is provided for dispensing water onto a surface 44*a* which is positioned closely adjacent to the evaporator 40. Preferably the dispenser 42*a* provides a discrete charge of water onto the surface 44*a* sufficient to fill the icemaking receptacle. The surface 44*a*, is in direct contact with some of the evaporator tubing, and thus is thermally influenced by the evaporator and, during operation of the evaporator, is caused to have its temperature lowered below freezing. Thus, when the water from the dispenser 42*a* is dispensed onto the surface 44*a*, the water freezes. Dispensing of ice from this type of conventional icemaking device is well known and not further described here.

Typically the evaporator 40 would be maintained at a temperature of approximately −6° to −10° C., so formation of ice will be possible even though the compartment cooled by that evaporator is maintained above 0° C. Also by providing a continuous water flow over the freezing surface it is possible to produce clear ice cubes similar to commercial icemakers, rather than cloudy ice cubes as occurs in conventional icemakers used in domestic refrigerators. More importantly, since the ice is made at a higher evaporating temperature, during the cooling of the fresh food compartment in a sequential operation, the energy used to make the same amount of ice will be considerably less than the ice made by conventional icemakers which are cooled in the freezer compartment with a colder evaporator. The energy efficiency of sequentially-operated dual evaporator refrigeration system is disclosed in co-pending U.S. Ser. No. 07/961,306, filed Oct. 15, 1992.

The initial portion of the evaporator tubing can be attached directly to the underside of surface 44 to assure that it cools quickly to just below freezing temperature. Further, the water supplied to the dispenser 42 can come from a conduit 62 which includes a significant length positioned within the fresh food compartment so that the water dispensed is already chilled. This will further accelerate the production of ice on the surface.

By utilizing a flat surface for surface 44, the ice forms as a slab on the surface. Means are provided to release the frozen slab from the surface 44, which may be in the form of resistance heating elements 46 positioned below the surface 44. The surface 44 is positioned at an angle from horizontal so that when the surface is heated, the slab will slide off of the surface 44 onto a grid screen 48. This screen may also be heated so that the slab melts into individual cubes which are then deposited by gravity in a bin 50 which preferably is surrounded by an insulating layer 52. The ice making surface 44 could also be designed to have individual cubes attached to each other with a thin layer of ice and when the ice is harvested into the bin 50, the bridges would break and individual ice cubes would result.

The insulated bin 50 is positioned within the fresh food compartment 30 and is accessible through the door 28 for the fresh food compartment. A well 60 is provided in the door 28 to permit dispensing of ice and, possibly water, directly through the fresh food compartment door.

Since the ice cubes are contained in an insulated bin 50, very little melting would occur even though the bin is positioned within the fresh food compartment. However, the melting of the ice is not lost energy since that melting would remove heat from the fresh food compartment helping to keep that compartment cold longer.

Of course, appropriate controls would be provided to determine if the storage bin is filled to prevent water from flowing over the surface 44 unless demand is made for additional ice cubes. Water resulting from the melting of any ice can be collected for dispensing through the well 60 since the water would be chilled and would have remained pure clean water for drinking purposes.

Figure 4:
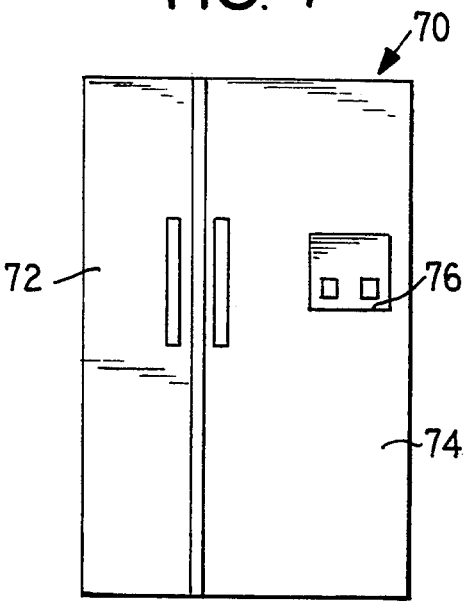
FIG. 4 is a perspective view of a side by side refrigeration device embodying the principles of the present invention.

FIG. 4 illustrates a side-by-side style of refrigeration appliance generally at 70 in which there is a first door 72 for providing access to a freezer compartment, and a second door 74 for providing access to a refrigeration compartment. A well 76 is provided in the refrigerator compartment door 74 for the dispensing of ice in accordance with the principles of this invention.

Figure 5:
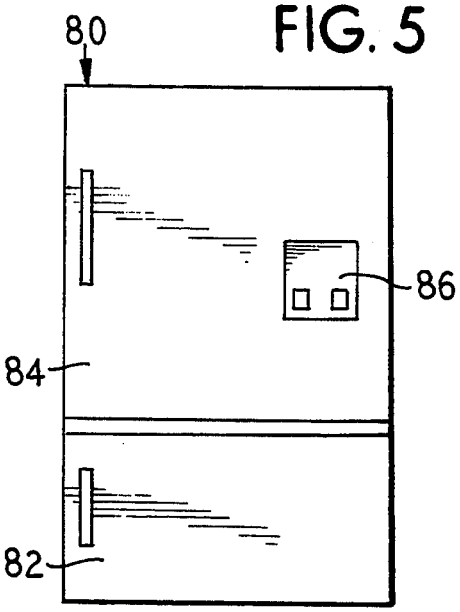
FIG. 5 is a perspective view of a bottom mount refrigeration device embodying the principles of the present invention.

FIG. 5 illustrates a bottom mount refrigeration appliance which has a bottom freezer compartment door 82 and an upper refrigeration compartment door 84. A well 86 is provided in the refrigeration compartment door 84 for the dispensing of ice through the refrigeration compartment door.

Thus it is seen that the present invention provides for the making of ice during the fresh food compartment cooling using a substantially warmer evaporator than typically used in making ice in the freezer compartment. Since the compressor cooling capacity is roughly doubled by utilizing a warmer evaporator, ample cooling capacity is provided to make plenty of ice. Experiments by Applicants have established that a pound of ice can be made within ten to twelve minutes as the fresh food compartment is cooled. Thus, the amount of ice typically stored in the storage bin for automatic icemakers can be made much smaller since the system provides ice cubes more rapidly. Further, the ice cubes are made at a much more energy efficient mode due to the higher evaporator temperatures.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A refrigeration appliance comprising:

a freezer compartment maintained at a temperature below 0° C.;

a fresh food compartment maintained at a temperature above 0° C. a door to said fresh food compartment;

a refrigeration system including a first evaporator operating at a first temperature for use in cooling said freezer compartment and a second evaporator operating at a second, higher evaporating temperature for use in cooling said fresh food compartment;

means for dispensing water onto a surface thermally influenced by said second evaporator in order to reduce the temperature of said water below 0° C. and to cause it to solidify into ice; and means for dispensing said ice from said surface to a point of utilization which is accessible through an aperture located in said door to said fresh food compartment.

2. A refrigeration appliance according to claim 1, wherein said means for dispensing water onto a surface comprises means for providing a continuous flow of water over said surface, with recirculation of any excess, unfrozen water.

3. A refrigeration appliance according to claim 1, wherein said surface comprises a flat surface.

4. A refrigeration appliance according to claim 1, wherein said means for dispensing said ice from said surface comprises means for heating said surface.

5. A refrigeration appliance according to claim 1, wherein said surface allows for formation of ice as a slab, and including means for dividing said slab into smaller ice pieces prior to dispensing to said point of utilization.

6. A refrigeration appliance according to claim 1, wherein said point of utilization comprises an insulated bin.

7. A refrigeration appliance according to claim 1, wherein said means for dispensing water onto a surface comprises means for providing a continuous flow of water over said surface, with recirculation of any excess, unfrozen water.

8. A refrigeration appliance according to claim 1, wherein said surface comprises a flat surface.

9. A refrigeration appliance according to claim 1, wherein said means for dispensing said ice from said surface comprises means for heating said surface.

10. A refrigeration appliance according to claim 1, wherein said surface allows for formation of ice as a slab, and including means for dividing said slab into smaller ice pieces prior to dispensing to said point of utilization.

11. A refrigeration appliance according to claim 1, wherein said point of utilization comprises an insulated bin.

12. A refrigeration appliance comprising:

a freezer compartment maintained at a temperature below 0° C.;

a fresh food compartment maintained at a temperature above 0° C. a door to said fresh food compartment;

refrigeration means for sequentially cooling each of said compartments, said refrigeration means operating at a first temperature to cool said freezer compartment and operating at a second higher temperature to cool said fresh food compartment;

means for dispensing water onto a surface thermally influenced by said refrigeration means while said refrigeration means is being used to cool said fresh food compartment in order to reduce the temperature of said water to below 0° C. and to cause said water to solidify into ice; and means for dispensing said ice from said surface to a point of utilization which is accessible through an aperture located in said door to said fresh food compartment.

13. A refrigeration appliance according to claim 12, wherein said refrigeration means comprises a first evaporator operating at a first temperature for maintaining said freezer compartment at a temperature below 0° C. and a second evaporator operating at a higher temperature for maintaining said fresh food compartment at a temperature above 0° C. and said surface being thermally influenced by said second evaporator.

14. A refrigeration appliance comprising:

a first compartment accessible through an openable door for storing foods in a frozen state;

a second compartment accessible through a second, separately openable door for storing foods in a chilled, but not frozen state;

refrigeration means for maintaining said first compartment at a temperature below 0° C. and for maintaining said second compartment at a temperature in the range of 5° to 15° C.;

means in said second compartment for freezing water into ice; and dispensing means in said door of said second compartment for dispensing said ice to the exterior of said door without requiring opening of said door.

15. A refrigeration appliance according to claim 14, wherein said refrigeration means comprises a first evaporator operating at a first temperature for cooling said first compartment and a second evaporator operating at a second, warmer temperature for cooling said second compartment.

16. A refrigeration appliance according to claim 14, wherein said refrigeration means for maintaining said second compartment at a temperature comprises an evaporator and wherein said means in said second compartment for freezing water into ice comprises means for dispensing water onto a surface thermally influenced by said evaporator.

17. A refrigeration appliance according to claim 15, wherein said surface allows for formation of ice as a slab, and including means for dividing said slab into smaller ice pieces accessible at said dispensing means.

* * * * *